United States Patent [19]

Crane

[11] 4,364,141

[45] Dec. 21, 1982

[54] SEWER CLEANING SHOE WITH DAM AND JET NOZZLES

[75] Inventor: Norman W. Crane, Thames Ditton, England

[73] Assignee: Thames Water Authority, London, England

[21] Appl. No.: 270,208

[22] Filed: Jun. 3, 1981

[30] Foreign Application Priority Data

Jun. 13, 1980 [GB] United Kingdom ..... 8019366

[51] Int. Cl.[3] ..... B08B 9/04

[52] U.S. Cl. ..... 15/104.06 R; 15/104.3 R

[58] Field of Search ..... 15/104.06 R, 104.3 R

[56] References Cited

U.S. PATENT DOCUMENTS

| | | | |
|---|---|---|---|
| 1,908,339 | 5/1933 | Frank | 15/104.06 R |
| 2,198,823 | 4/1940 | Kelpsh | 15/104.3 R |
| 2,576,197 | 11/1951 | Stephens | 15/104.06 R |
| 3,882,566 | 5/1975 | Hubbell | 15/104.3 R |

*Primary Examiner*—Edward L. Roberts

*Attorney, Agent, or Firm*—Sughrue, Mion, Zinn, Macpeak and Seas

[57] ABSTRACT

A sewer cleaning shoe for use in removing the detritus and sedimentary matter that accumulates in the invert of sewers comprises a partly-cylindrical framework (1, 11, 14, 19) which fits in the invert of a sewer, a transverse barrier (2, 5, 23) which is connected to the framework and which, in use, substantially fills the lower part of a sewer but stops short of the top of the sewer to form a dam extending across the sewer, and an orifice (6, 18) through the transverse barrier adjacent its base through which, in use, a part of the effluent carried by the sewer is jetted to scour the detritus and sedimentary matter from the invert of the sewer. The transverse barrier stops short of the top of the sewer and provides a weir over which the remainder of the effluent flow takes place. The jet of effluent from the orifice scours and loosens the detritus and concretions that have accumulated in the invert of the sewer, and then the loosened material is entrained by the cascade of effluent flowing over the weir at the top of the transverse barrier. The entrained detritus and sedimentary matter is then carried forward with the effluent towards the downstream end of the sewer.

11 Claims, 6 Drawing Figures

SEWER CLEANING SHOE WITH DAM AND JET NOZZLES

BACKGROUND OF THE INVENTION

This invention relates to a shoe for use in removing the detritus and sedimentary matter that accumulates in the invert of sewers.

At present, this material is removed in a variety of ways depending upon the size of the sewer. With large diameter sewers this matter is removed by gangs of men called flushers who use shovels and skips within the sewers pushing the loaded skips to manholes where they are removed and unloaded. Not only is this job undesirable but also this technique does not provide a very effective removal of the detritus and sedimentary matter. With smaller diameter sewers some attempts have been made to winch with a wire and cone attachment through from one end to the other but nowadays jetting techniques are widely used in which a hose containing water under high pressure is passed through the sewer with water being jetted from a nozzle at the end of the hose to scour the detritus and sedimentary matter from the sewer as the hose moves along. In practice, a portion of the water is jetted in the backwards direction to drive the hose through the sewer. This technique is generally successful but the apparatus is very expensive and, overall, has a low productivity because of the large proportion of down time that occurs while it is being set up, dismantled and recharged.

SUMMARY OF THE INVENTION

According to this invention a sewer cleaning shoe comprises a partly-cylindrical framework which fits in the invert of a sewer, a transverse barrier which is connected to the framework and which, in use, substantially fills the lower part of a sewer but stops short of the top of the sewer to form a dam extending across the sewer, and an orifice through the transverse barrier adjacent its base through which, in use, a part of the effluent carried by the sewer is jetted to scour the detritus and sedimentary matter from the invert of the sewer.

Since the transverse barrier stops short of the top of the sewer it provides a weir over which the remainder of the effluent flow takes place. The jet of effluent from the orifice scours and loosens the detritus and concretions that have accumulated in the invert of the sewer, and then the loosened material is entrained by the cascade of effluent flowing over the weir at the top of the transverse barrier. The entrained detritus and sedimentary matter is then carried forward with the effluent towards the downstream end of the sewer.

The base of the framework may include wheels or castors to help the framework run along the invert of the sewer, but preferably it includes skids so that the shoe is formed like a sled. The weight of the water that builds up behind the transverse barrier or dam urges the shoe in the forward direction along the sewer but the detritus and sedimentary matter present in the invert prevent the movement of the shoe along the sewer. Therefore, the movement of the shoe along the sewer is self-regulating, with the shoe only moving forwards along the sewer when the path immediately in front of the shoe has been cleared of detritus and sedimentary matter. Naturally, the thicker and heavier the build up of the concretions of detritus and sedimentary matter the slower the movement of the shoe along the sewer and so the greater the back-up of effluent behind the shoe. The greater the back-up of effluent, the greater the head of effluent behind the shoe and so the faster the flow of effluent through the orifice and the greater the turbulence of the effluent overflowing the top of the dam, which leads to a greater scouring taking place.

Preferably the transverse barrier is inclined to the vertical or stepped, so that the top of the barrier is forward of its base. With the barrier arranged in this way, the front of the shoe is urged downwards and this prevents the front of the shoe lifting to allow it to ride over the accumulations of detritus and sedimentary matter in the invert of the sewer. When the barrier is inclined, the entire barrier may be inclined, or alternatively, just the top portion of the barrier may be inclined. The inclination of the barrier also helps to speed the flow of effluent over the weir formed by the top of the barrier.

The orifice may be a simple orifice through the base of the transverse barrier but preferably it is formed as the outlet of an elongate nozzle. This provides a more effective jet of effluent since the jet is less turbulent and has a greater velocity and so scours the detritus and sedimentary matter more effectively. Preferably the upstream entry to the nozzle is shaped like a funnel which also improves the velocity of flow of effluent through the orifice and helps to prevent the orifice being blocked by rags. Preferably the shoe includes three orifices or nozzles. The, or the central and lowermost, nozzle is arranged to provide a jet the axis of which extends in a direction parallel to the axis of the framework of the shoe and hence, parallel to the axis of the sewer. When the shoe includes three nozzles it is preferred that the two outermost nozzles are arranged so that the axes of their jets are angled downwards and slightly towards one another so that all three jets converge towards the invert of the sewer.

The location of the top of the transverse barrier and that of the orifice or orifices or the outlet of the nozzle or nozzles is preferably arranged such that the cascade of effluent overflowing the top of the barrier falls in front of the jet or jets of effluent produced by the or each orifice or nozzle. Naturally the effluent overflowing the top of the transverse barrier moves both forwards and downwards and so impinges on the invert of the sewer downstream of the top of the barrier so that, even through the top of the barrier may be located behind the or each orifice or nozzle, the cascade of effluent falls in front of the or each orifice or nozzle. This arrangement of the shoe means that the jet of effluent leaving the or each orifice or nozzle immediately downstream of the or each orifice or nozzle is undisturbed by the cascade of effluent over the top of the barrier, but that at a point downstream of the or each orifice or nozzle the jet or jets of effluent and the cascade of effluent meet.

Preferably the framework includes at least one projection extending forwards from the orifices. The projection or projections are arranged so that, in use, they lie adjacent the invert of the sewer and engage any accumulations of detritus or sedimentary matter that have accumulated in the invert of the sewer. The engagement of the projections on the accumulated detritus or sedimentary matter prevent the forwards movement of the shoe until the detritus and sedimentary matter has been scoured. Since the projections project forwards in front of the orifice or orificies, they engage the accumulation of detritus and sedimentary matter and so prevent the orifice or orifices becoming blocked by the sedimentary matter.

Preferably the entire shoe is constructed from a number of separate pieces so that it can be assembled and dismantled easily with each of the separate pieces being capable of passing through a two foot square, (600 mm square) manhole and with each piece being sufficiently light in weight to enable it to be comfortably handled by one person, or at most, two people.

BRIEF DESCRIPTION OF THE DRAWINGS

Two particular examples of sewer cleaning shoes in accordance with this invention will now be described with reference to the accompanying drawings; in which.

DETAILED DESCRIPTION OF THE PREFERRED EMBODIMENTS

Figure 1:
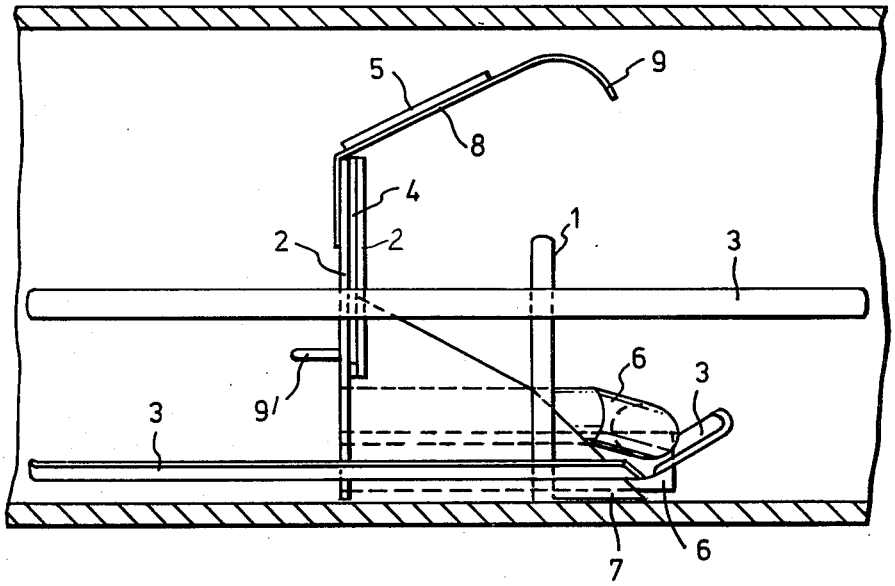
FIG. 1 is a side elevation of a first example of a sewer cleaning shoe showing it located in a cutaway pipe.
Figure 2:
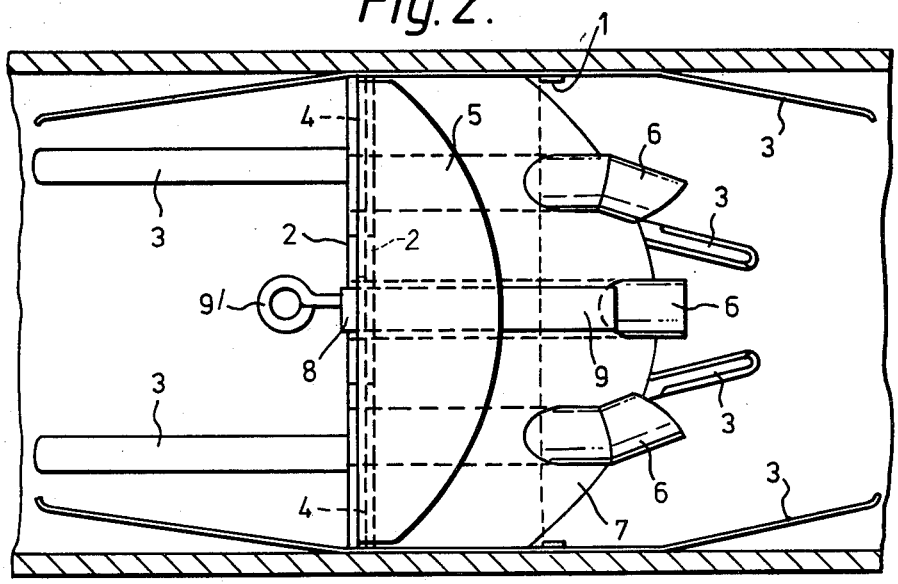
FIG. 2 is a plan of the first example again showing it located in a cut away pipe.
Figure 3:
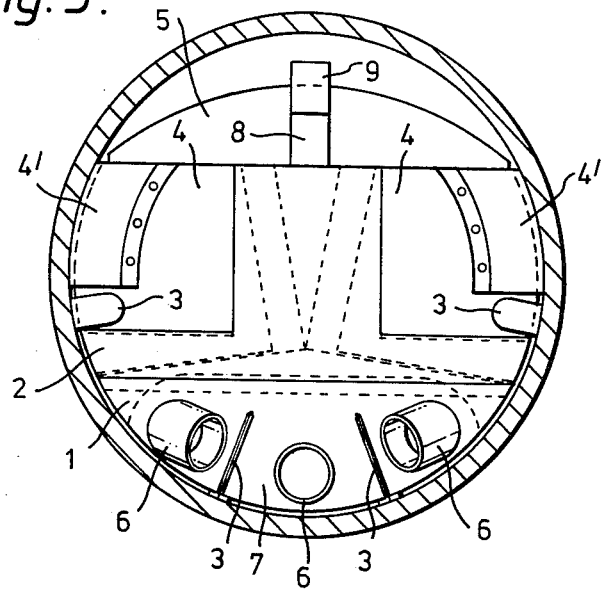
FIG. 3 is a front elevation of the first example.
Figure 4:
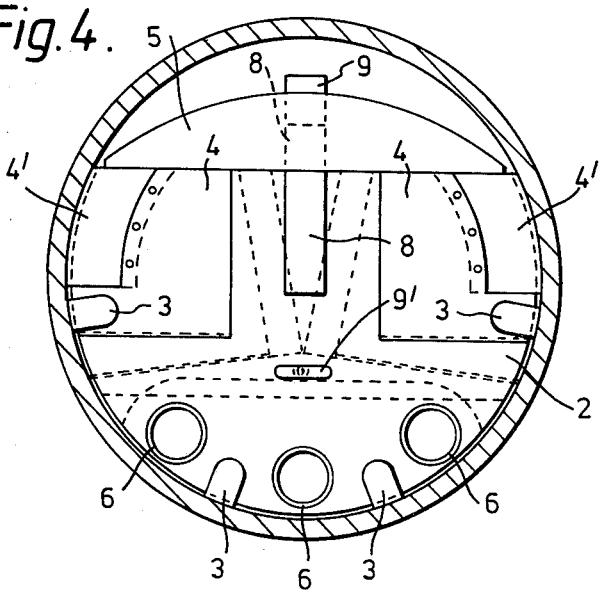
FIG. 4 is a rear elevation of the first example.
Figure 5:
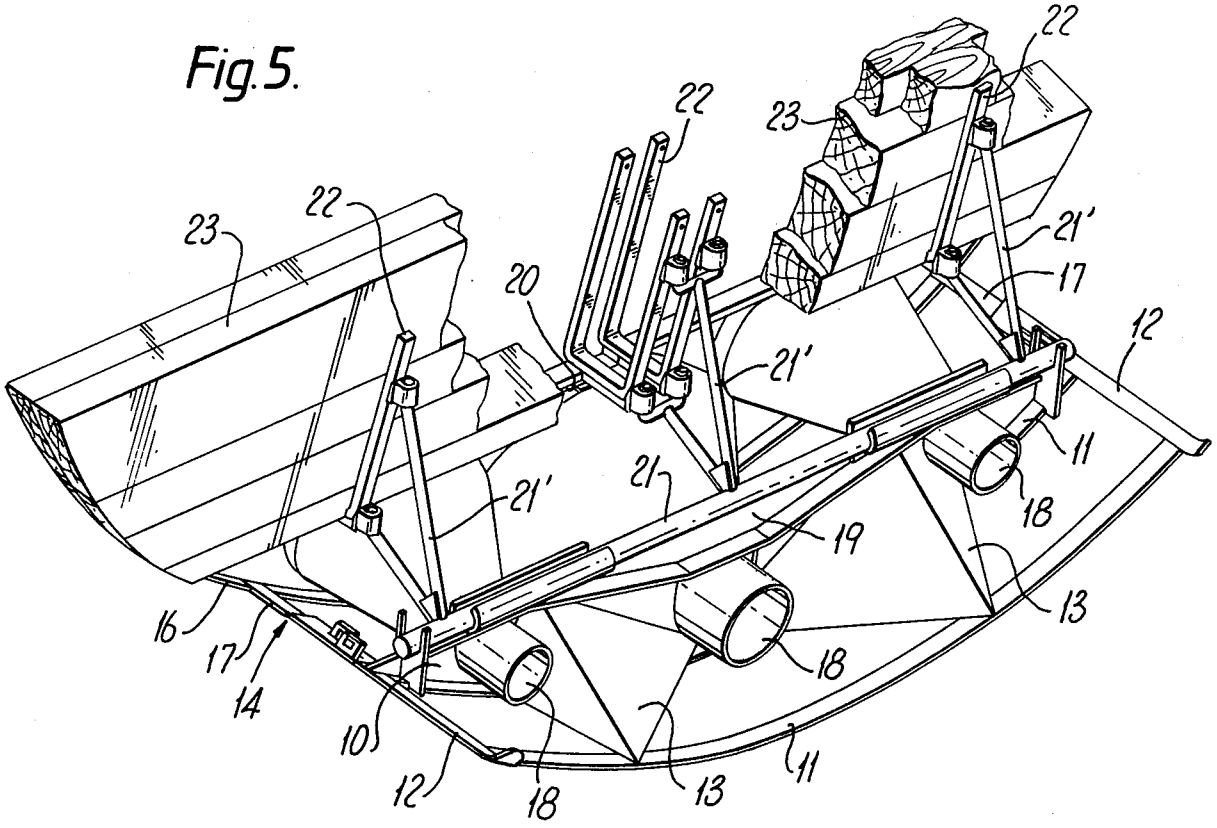
FIG. 5 is a partly cut away perspective view of a second example from above and from the downstream end; and, FIG. 6 is a partly cut away perspective view of the upstream end of the second example.
Figure 6:
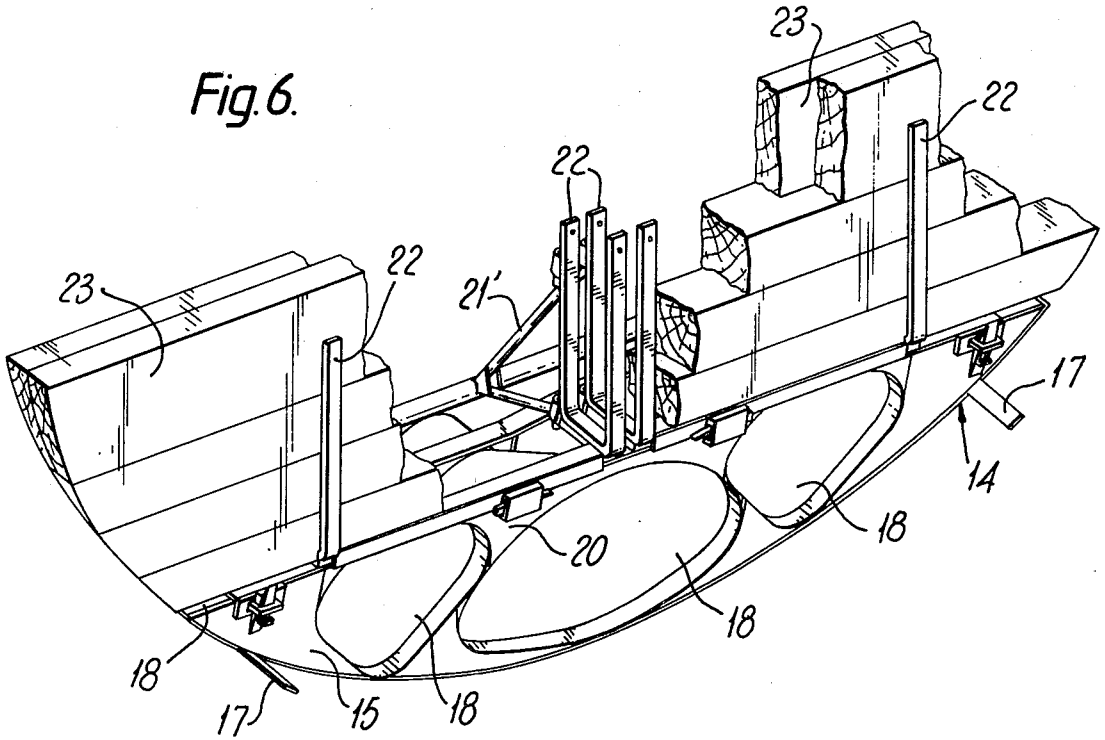

The first example of sewer cleaning shoe is intended to clean small diameter sewers which typically have a diameter of 12" (300 mm). The sewer cleaning shoe comprises a framework formed by a front plate 1, a rear plate assembly 2 and four skids 3. The shoe also comprises extension plates 4 and a weir plate 5 and three nozzles 6. The outer nozzles converge towards the central nozzle. A projection 7 of plastics resin material is formed on the downstream side of the front plate 1. The front plate 1, the rear plate assembly 2, the skids 3 and the nozzles 6 are all welded together. The rear plate assembly 2 is formed from two separate plates with a spacer between them and the extension plates 4 are a sliding fit between the two plates forming the rear plate assembly 2. This provides a limited variation in the width of the device to allow it to be set to correspond closely to that of the sewer pipe. The extension plates 4 preferably have a flexible strip 4' at their outer edges to accommodate irregularities in the wall of the sewer pipe. The weir plate 5 is welded to a bracket 8 having a curved end portion 9. The bracket 8 is connected onto the rear plate assembly 2 by two screws. The bracket 8 locates the weir plate 5 in position and its curved end portion 9 acts as an additional skid or guide in the event of the sewer including an irregularities.

As an alternative, the sewer cleaning shoe may include flexible resilient plates which together form the transverse barrier and replace the extension plates 4 to enable it to accommodate more easily irregularities in the sewer pipe.

In use, the sewer cleaning shoe is placed down a manhole and laid into the invert of a sewer. The extension plates 4 are adjusted so that the width of the shoe conforms to the diameter of the sewer with the strips 4' engaging the wall of the sewer pipe. The rear plate assembly 2, the extension plates 4 and the weir plate 5 together form a dam or transverse barrier means substantially filling the lower part of the sewer and so preventing the flow of effluent through the sewer. This causes the effluent to back-up behind the dam and this leads to the level of effluent behind the dam rising. Effluent flows through the nozzles 6 and as the head of effluent builds up behind the dam, the velocity of the jet of effluent passing through the nozzles 6 increases until it reaches a maximum when effluent is also overflowing the top of the weir plate 5. The pressure of water behind the dam urges the shoe forwards and it continues to move forwards until the projection 7 engages any accumulations or concretions of detritus or sedimentary matter that have accumulated in the invert of the sewer. These accumulations halt the movement of the shoe through the sewer but the jets of effluent passing through the nozzles 6 scour the detritus and accumulations of sedimentary matter and so loosen and fluidise them. The overflow of effluent over the top of the weir plate 5 entrains this loosened detritus and sedimentary matter and carries it away down the remainder of the sewer. The leading edges of the bottom pair of skids 3 may be ground to a knife edge to assist in breaking up and dislodging any accumulated concretions of detritus or sedimentary matter present on the invert of the sewer.

The detritus and sedimentary matter which is entrained with the flow of effluent along the sewer may be collected by a sediment collection bucket located in the next manhole downstream, or, alternatively, the shoe may be used to cause the detritus and sedimentary matter to flow along the entire length of the sewer and then be removed at the sewage treatment plant. A drag rope (not shown) may be connected to an eye bolt 9' on the upstream side of the dam to enable the shoe to be recovered in case it somehow becomes jammed in the sewer. However, this is not usually necessary because the upturned ends of the skids 3 and the curved end portion 9 of the spigot 8 has been found to provide sufficient lead-in to the remainder of the shoe to ensure that the shoe rides over any slight irregularities and misalignments between individual pipes of the sewer.

When the flow of effluent through a sewer is very limited it is possible to block off one or more of the nozzles 6 by including a plug in its upstream end to ensure that a sufficient back-up of effluent takes place behind the dam to drive the shoe through the sewer pipe and to give a sufficient head of effluent to provide a sufficiently high velocity jet of effluent to scour the accumulations of detritus and sedimentary matter from the invert of the sewer.

The second example in accordance with this invention intended for cleaning large diameter sewers such as those having a diameter of between 4 and 12 feet (1200 mm and 4000 mm). This example is similar to the first example although constructed much more robustly and constructed in "knock-down" form from a number of separate units. The second example comprises a front frame unit formed by a front frame member 10 and a pair of ribs 11 connected to the front parts of a pair of skids 12 and a pair of projections 13. A rear frame unit 14 includes includes a rear frame member 15 connected to a rib 16 and rear parts 17 of the skids. The front frame unit and the rear frame unit 14 are connected together by a hasp and staple connection locked in place by a pair of metal wedges. Funnel-shaped nozzles 18 are fitted between the rear frame member 15 and the front frame member 10 and then locked in position by front and rear top frame members 19 and 20 respectively and the front and rear top frame members 19 and 20 are connected to their frames by hasp and staple connections secured by wedges. A connecting bar 21 slots into the front frame top member 19 and two pairs of U-shaped weir board supports 22 are connected onto the rear frame top member 20. Sockets attached to the front face of the U-shaped weir board supports 22 connect the weir board supports to the connecting bar 21 via rods 21'. Weir boards 23 are slotted between the U-shaped weir board supports 22 and are locked in place by pins (not shown) passing through holes in the free ends of the U-shaped weir board supports 22. The two pairs of weir board supports 22 are connected to the top rear frame member 20 by a C-shaped clamp with a wedge-shaped locking element.

In operation, the second example is substantially the same as the first. Firstly, it is assembled piece-by-piece in a manhole and then introduced into the invert of the sewer. Once again, as the level of effluent builds up behind the weir boards, streams of effluent are jetted through the nozzles 18 and these scour the detritus and sedimentary material that has collected in the invert of the sewer with the cascade of effluent overflowing over the top of the weir boards 23 carrying away the scoured detritus and sedimentary matter.

We claim:

1. A sewer cleaning shoe comprising a partly-cylindrical framework for location in the invert of a sewer; transverse barrier means connected to said framework, said transverse barrier means being arranged to substantially fill the lower part of said sewer to form a dam extending across said sewer, said transverse barrier means having a top edge arranged below the top of said sewer; and, an orifice through said transverse barrier means adjacent its base, whereby a part of the flow of effluent carried by said sewer is jetted through said orifice to scour the detritus and sedimentary matter from said invert of said sewer and a part of said flow of effluent flows over said top of said transverse barrier means to entrain and carry away said scoured detritus and sedimentary matter.

2. The sewer cleaning shoe of claim 1, wherein said base of said framework includes skids whereby said shoe is formed like a sled.

3. The sewer cleaning shoe of claim 1,wherein said transverse barrier means includes a portion inclined to the vertical whereby said top of said transverse barrier means is forward of its base.

4. The sewer cleaning shoe of claim 3, wherein only an upper portion of said transverse barrier means is inclined.

5. The sewer cleaning shoe of claim 1, wherein said orifice is formed as an outlet of an elongate nozzle.

6. The sewer cleaning shoe of claim 5, wherein said nozzle includes an upstream entry shaped like a funnel whereby the velocity of flow of said effluent through said orifice is increased.

7. The sewer cleaning shoe of claim 5 or 6, wherein said shoe includes three nozzles, a centrally located and lowermost nozzle arranged to provide a jet of effluent extending in a direction parallel to an axis of said framework of said shoe and the two outermost nozzles arranged whereby their jets of effluent are angled downwards and slightly towards one another, all three jets of effluent converging towards said invert of said sewer.

8. The sewer cleaning shoe of claim 1, wherein the location of said top of said transverse barrier and that of said orifice are arranged whereby said cascade of effluent overflowing over said top of said transverse barrier falls in front of said jet of effluent produced by said orifice.

9. The sewer cleaning shoe of claim 1, wherein said framework includes at least one projection extending forwards in front of said orifice with said projection arranged adjacent said invert of said sewer whereby said projection engages any accumulations of detritus or sedimentary matter in said invert of said sewer.

10. The sewer cleaning shoe of claim 1, wherein said entire shoe is constructed from a number of separate pieces each of said separate pieces being capable of passing through a two foot square manhole.

11. A sewer cleaning shoe comprising:

a sled-like partly-cylindrical framework including skids for location in the invert of a sewer;

transverse barrier means connected to said framework, said transverse barrier means being arranged to substantially fill the lower part of said sewer to form a dam extending across said sewer, said transverse barrier means having a top edge arranged below the top of said sewer, said transverse barrier means including a portion inclined to the vertical, whereby said top edge of said transverse barrier means is forward of its base;

three elongate nozzles extending through said transverse barrier means adjacent its base, a centrally located and lowermost nozzle arranged to provide a jet of effluent extending in a direction parallel to an axis of said framework of said shoe and the two outermost nozzles arranged to provide jets of effluent which are angled downwards and slightly towards one another whereby all three jets of effluent converge towards said invert of said sewer;

at least one projection attached to said framework and extending forwards in front of said nozzles with said projection arranged adjacent said invert of said sewer whereby said projection engages any accumulations of detritus or sedimentary matter in said invert of said sewer, a part of the flow of effluent carried by said sewer being jetted through said nozzles to scour detritus and sedimentary matter from said invert of said sewer and a part of said flow of effluent flow over said top edge of said transverse barrier means to entrain and carry away said scoured detritus and sedimentary matter, said location of said top edge of said transverse barrier means and that of said nozzles being arranged whereby said cascade of effluent overflowing over said top edge of said transverse barrier means falls in front of said jets of effluent produced by said nozzles.

* * * * *